US009833991B2

(12) United States Patent
Edelen et al.

(10) Patent No.: US 9,833,991 B2
(45) Date of Patent: Dec. 5, 2017

(54) PRINTHEAD AND AN INKJET PRINTER

(71) Applicant: FUNAI ELECTRIC CO., LTD., Osaka (JP)

(72) Inventors: John Glenn Edelen, Lexington, KY (US); Nicole Semler, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 18 days.

(21) Appl. No.: 14/500,839

(22) Filed: Sep. 29, 2014

(65) Prior Publication Data

US 2016/0089885 A1 Mar. 31, 2016

(51) Int. Cl.
*B41J 2/14* (2006.01)
*B41J 2/045* (2006.01)

(52) U.S. Cl.
CPC ..... *B41J 2/14072* (2013.01); *B41J 2/0458* (2013.01); *B41J 2/04543* (2013.01); *B41J 2202/13* (2013.01)

(58) Field of Classification Search
CPC ..... B41J 2/14072; B41J 2/14112; B41J 2202/16; B41J 2202/18
See application file for complete search history.

(56) References Cited

U.S. PATENT DOCUMENTS 5,363,134 A 11/1994 Barbehenn et al.
5,541,629 A 7/1996 Saunders et al.
5,600,354 A 2/1997 Hackleman et al.
6,154,395 A * 11/2000 Saka ..... 365/193
6,481,817 B1 11/2002 Torgerson et al.
6,507,117 B1 * 1/2003 Hikita ..... H01L 23/49575 257/778
7,090,338 B2 8/2006 Axtell et al.
7,244,015 B2 7/2007 Parish et al.
2004/0119781 A1 * 6/2004 Szumla ..... 347/50
2004/0125157 A1 * 7/2004 Edelen et al. ..... 347/9
2005/0134620 A1 * 6/2005 Hirayama ..... B41J 2/04541 347/9
2006/0232411 A1 * 10/2006 Torchalski ..... G06K 17/0025 340/572.1

(Continued)

FOREIGN PATENT DOCUMENTS

JP 200934920 2/2009
JP 2010228231 10/2010

*Primary Examiner* — Kristal Feggins
*Assistant Examiner* — Kendrick Liu
(74) *Attorney, Agent, or Firm* — Amster, Rothstein & Ebenstein, LLP

(57) ABSTRACT

A printhead including a fluid ejector chip having an electrical interface. The electrical interface includes one or more inputs for receiving respective primitive address data and heater address data corresponding to each of one or more address cycles, at least one of the one or more inputs being switchable to a deactivated state, and one or more shift registers, a total number of shift registers being adjustable so that each of the one or more shift registers corresponds to a respective one of the one or more inputs that is not in a deactivated state, the one or more shift registers receiving the respective primitive address data and heater address data from the one or more inputs that are not in a deactivated state to allow for selective application of electrical signals to the heating elements so that fluid is ejected from the fluid ejector chip in accordance with image data.

8 Claims, 5 Drawing Sheets

(56) References Cited

U.S. PATENT DOCUMENTS

| | | | | |
|---|---|---|---|---|
| 2008/0228951 | A1* | 9/2008 | Chow | H03K 19/1733 710/10 |
| 2009/0284557 | A1 | 11/2009 | Sugita | |
| 2013/0314464 | A1 | 11/2013 | Kudo et al. | |

* cited by examiner

PRINTHEAD AND AN INKJET PRINTER

FIELD

This invention is related to inkjet printheads, and in particular, to systems and methods for controlling inkjet printheads.

BACKGROUND

Developing a configurable architecture for an inkjet heater chip allows for multiple applications of the design as well as more opportunities for Original Equipment Manufacturer (OEM) vendors. One of the fundamental specifications of a chip is the number of required data input pads and the rate at which serial data is clocked to the chip. These design variables are inversely related; reducing the number of inputs would require an increase in the clock rate in order to transfer the same amount of data.

In a consumer printer application where minimizing printer cost is a design goal, it would be advantageous to use the traditional method of serial communication from the print engine to a passive carrier card along a ribbon cable. The resistive and capacitive nature of the ribbon cable itself limits the rate at which data can be reliably transmitted. For this case, supporting more inputs at a slower clock rate may be the optimal design point.

In certain OEM applications like a large format plotter, multiple printheads may be used in a staggered configuration to achieve the necessary print speeds. For this type of system, performance may be the primary design goal with plotter cost being secondary. In this case, data can be transferred from a print engine to a carrier card with a local digital ASIC capable of driving multiple heads. For this configuration, the cable distance is minimized so it is desirable to increase the data rate while reducing the number of outputs required by the local ASIC. In past heater chip designs the clock rate and number of inputs has been fixed.

SUMMARY OF THE INVENTION

An object of the present invention is to provide a printhead circuit and method that allows for a configurable combination of inputs and data rates.

Another object of the present invention is to provide an inkjet heater chip architecture where the clock speed and number of I/O pads are user selectable. This allows for a single design to fit the needs of multiple applications and markets.

A printhead according to an exemplary embodiment of the present invention comprises: a fluid ejector chip comprising a first number of heating elements, the heating elements being divided into groups of a second number of heating elements so as to form a number of primitive groups, one or more of the first number of heating elements being fired simultaneously during each of one or more address cycles of a printing operation; and an electrical interface comprising: one or more inputs for receiving respective primitive address data and heater address data corresponding to each of the one or more address cycles, at least one of the one or more inputs being switchable to a deactivated state; and one or more shift registers, a total number of shift registers being adjustable so that each of the one or more shift registers corresponds to a respective one of the one or more inputs that is not in a deactivated state, the one or more shift registers receiving the respective primitive address data and heater address data from the one or more inputs that are not in a deactivated state to allow for selective application of electrical signals to the heating elements so that fluid is ejected from the fluid ejector chip in accordance with image data.

In an exemplary embodiment, the printhead further comprises one or more fuse circuits for switching the at least one of the one or more inputs to the deactivated state.

In an exemplary embodiment, the at least one of the one or more inputs is switched to a deactivated state in accordance with an input data stream.

In an exemplary embodiment, the total number of bits in each shift register is determined as follows: (total number of bits required to address a maximum number of the one or more heating elements simultaneously per address cycle)/(total number of inputs).

An inkjet printer according to an exemplary embodiment of the present invention comprises: a housing; a carriage adapted to reciprocate along a shaft disposed within the housing; one or more printhead assemblies arranged on the carriage so that the one or more printhead assemblies eject ink onto a print medium as the carriage reciprocates along the shaft in accordance with a control mechanism, wherein at least one of the one or more printhead assemblies comprises: a printhead comprising: a fluid ejector chip comprising a first number of heating elements, the heating elements being divided into groups of a second number of heating elements so as to form a number of primitive groups, one or more of the first number of heating elements being fired simultaneously during each of one or more address cycles of a printing operation; and an electrical interface comprising: one or more inputs for receiving respective primitive address data and heater address data corresponding to each of the one or more address cycles, at least one of the one or more inputs being switchable to a deactivated state; and one or more shift registers, a total number of shift registers being adjustable so that each of the one or more shift registers corresponds to a respective one of the one or more inputs that is not in a deactivated state, the one or more shift registers receiving the respective primitive address data and heater address data from the one or more inputs that are not in a deactivated state to allow for selective application of electrical signals to the heating elements so that fluid is ejected from the fluid ejector chip in accordance with image data.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
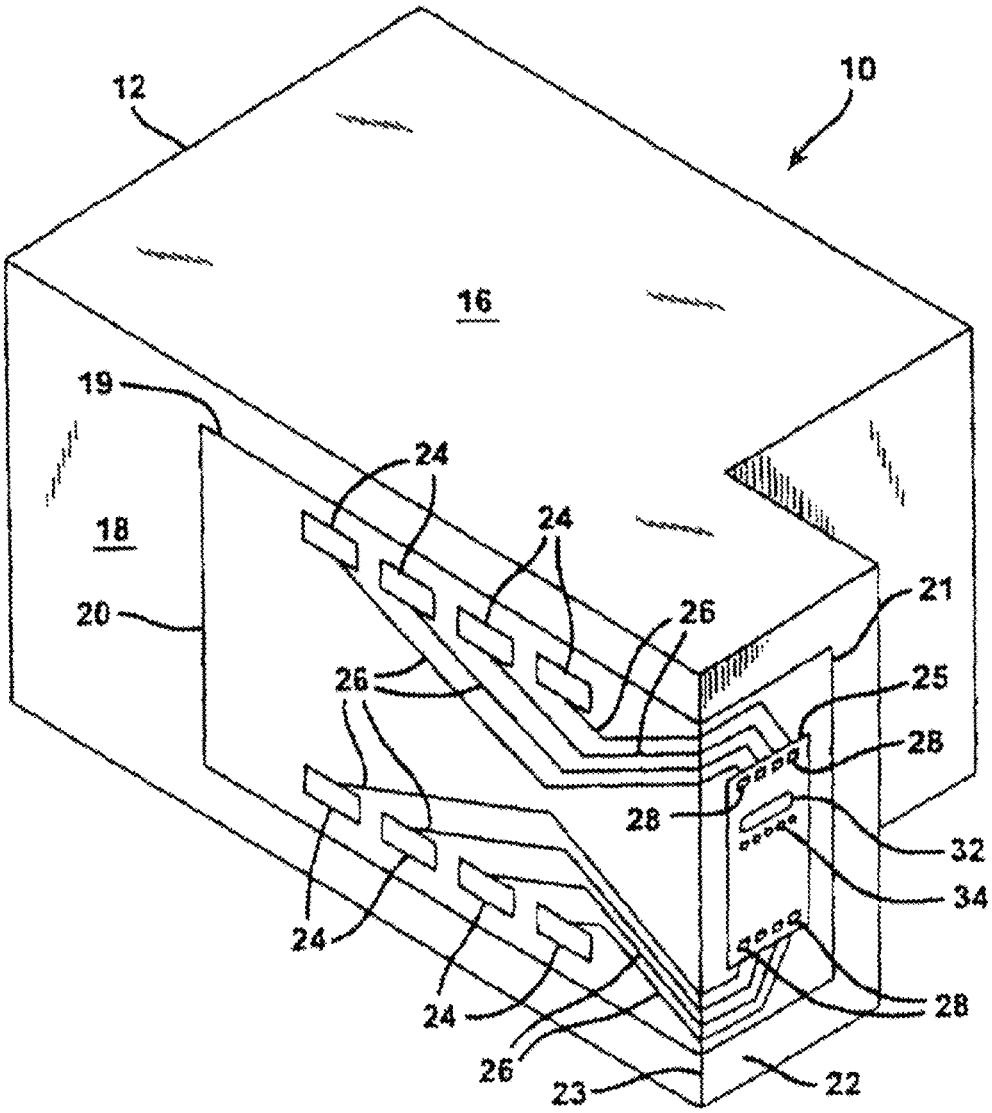
FIG. 1 is a perspective view of a conventional inkjet printhead.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

With reference to FIG. 1, an inkjet printhead of the present invention is shown generally as 10. The printhead 10 has a housing 12 formed of any suitable material for holding ink. Its shape can vary and often depends upon the external device that carries or contains the printhead. The housing has at least one compartment 16 internal thereto for holding an initial or refillable supply of ink. In one embodiment, the compartment has a single chamber and holds a supply of black ink, photo ink, cyan ink, magenta ink or yellow ink. In other embodiments, the compartment has multiple chambers and contains three supplies of ink. Preferably, it includes cyan, magenta and yellow ink. In still other embodiments, the compartment contains plurals of black, photo, cyan, magenta or yellow ink. It will be appreciated, however, that while the compartment 16 is shown as locally integrated within a housing 12 of the printhead, it may alternatively connect to a remote source of ink and receive supply from a tube, for example.

Adhered to one surface 18 of the housing 12 is a portion 19 of a flexible circuit, especially a tape automated bond (TAB) circuit 20. The other portion 21 of the TAB circuit 20 is adhered to another surface 22 of the housing. In this embodiment, the two surfaces 18, 22 are perpendicularly arranged to one another about an edge 23 of the housing.

The TAB circuit 20 supports a plurality of input/output (I/O) connectors 24 thereon for electrically connecting a heater chip 25 to an external device, such as a printer, fax machine, copier, photo-printer, plotter, all-in-one, etc., during use. Pluralities of electrical conductors 26 exist on the TAB circuit 20 to electrically connect and short the I/O connectors 24 to the input terminals (bond pads 28) of the heater chip 25. Those skilled in the art know various techniques for facilitating such connections. For simplicity, FIG. 1 only shows eight I/O connectors 24, eight electrical conductors 26 and eight bond pads 28 but present day printheads have much larger quantities and any number is equally embraced herein. Still further, those skilled in the art should appreciate that while such number of connectors, conductors and bond pads equal one another, actual printheads may have unequal numbers.

The heater chip 25 contains a column 34 of a plurality of fluid firing elements that serve to eject ink from compartment 16 during use. The fluid firing elements may embody thermally resistive heater elements (heaters for short) formed as thin film layers on a silicon substrate or piezoelectric elements despite the thermal technology implication derived from the name heater chip. For simplicity, the pluralities of fluid firing elements in column 34 are shown adjacent an ink via 32 as a row of five dots but in practice may include several hundred or thousand fluid firing elements. As described below, vertically adjacent ones of the fluid firing elements may or may not have a lateral spacing gap or stagger there between. In general, the fluid firing elements have vertical pitch spacing comparable to the dots-per-inch resolution of an attendant printer. Some examples include spacing of $1/300_{th}$, $1/600_{th}$, $1/1200_{th}$, $1/2400_{th}$ or other of an inch along the longitudinal extent of the via. To form the vias, many processes are known that cut or etch the via 32 through a thickness of the heater chip. Some of the more preferred processes include grit blasting or etching, such as wet, dry, reactive-ion-etching, deep reactive-ion-etching, or other. A nozzle plate (not shown) has orifices thereof aligned with each of the heaters to project the ink during use. The nozzle plate may attach with an adhesive or epoxy or may be fabricated as a thin-film layer.

Figure 2:
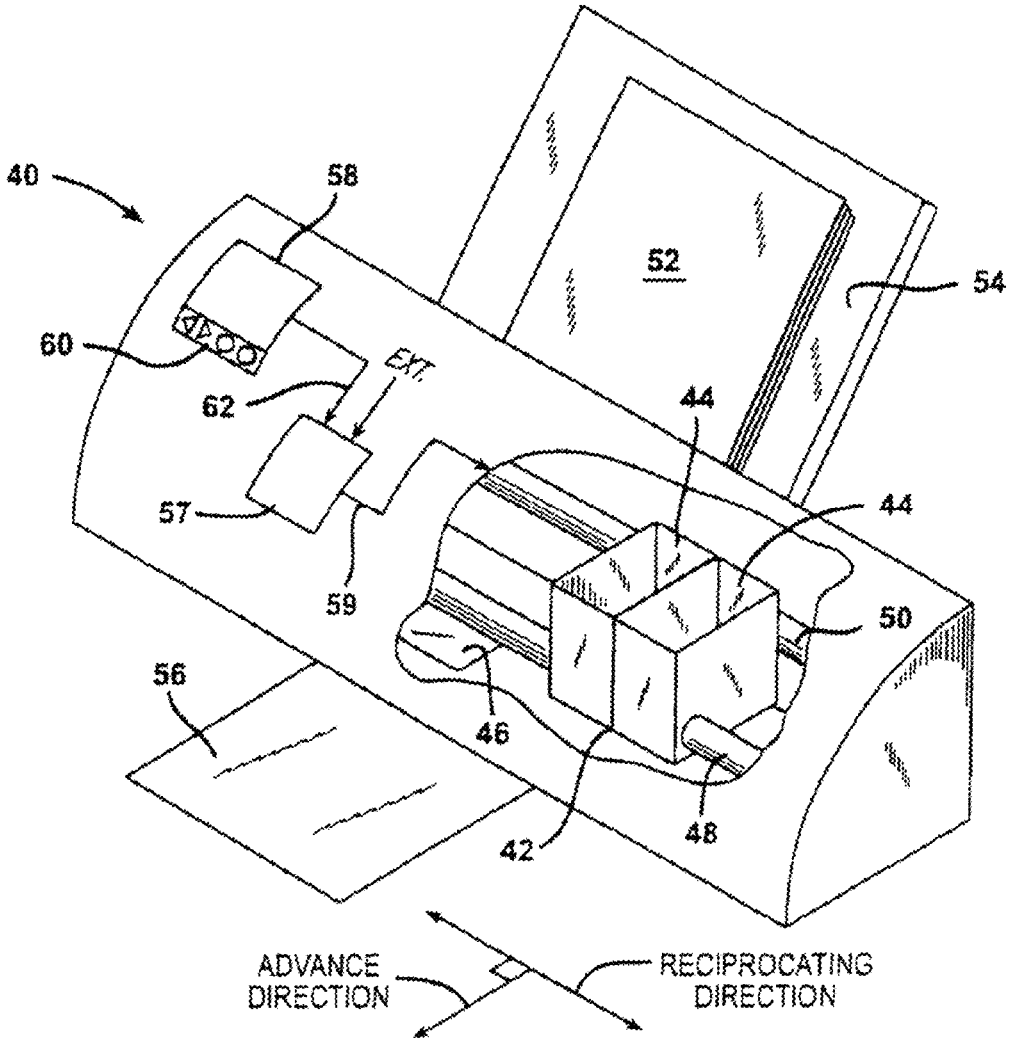
FIG. 2 is a perspective view of a conventional inkjet printer.

With reference to FIG. 2, an external device in the form of an inkjet printer for containing the printhead 10 is shown generally as 40. The printer 40 includes a carriage 42 having a plurality of slots 44 for containing one or more printheads 10. The carriage 42 reciprocates (in accordance with an output 59 of a controller 57) along a shaft 48 above a print zone 46 by a motive force supplied to a drive belt 50 as is well known in the art. The reciprocation of the carriage 42 occurs relative to a print medium, such as a sheet of paper 52 that advances in the printer 40 along a paper path from an input tray 54, through the print zone 46, to an output tray 56.

While in the print zone, the carriage 42 reciprocates in the Reciprocating Direction generally perpendicularly to the paper 52 being advanced in the Advance Direction as shown by the arrows. Ink drops from compartment 16 (FIG. 1) are caused to be eject from the heater chip 25 at such times pursuant to commands of a printer microprocessor or other controller 57. The timing of the ink drop emissions corresponds to a pattern of pixels of the image being printed. Often times, such patterns become generated in devices electrically connected to the controller 57 (via Ext. input) that reside externally to the printer and include, but are not limited to, a computer, a scanner, a camera, a visual display unit, a personal data assistant, or other.

To print or emit a single drop of ink, the fluid firing elements (the dots of column 34, FIG. 1) are uniquely addressed with a small amount of current to rapidly heat a small volume of ink. This causes the ink to vaporize in a local ink chamber between the heater and the nozzle plate and eject through, and become projected by, the nozzle plate towards the print medium. The fire pulse required to emit such ink drop may embody a single or a split firing pulse and is received at the heater chip on an input terminal (e.g., bond pad 28) from connections between the bond pad 28, the electrical conductors 26, the I/O connectors 24 and controller 57. Internal heater chip wiring conveys the fire pulse from the input terminal to one or many of the fluid firing elements.

A control panel 58, having user selection interface 60, also accompanies many printers as an input 62 to the controller 57 to provide additional printer capabilities and robustness.

Figure 3:
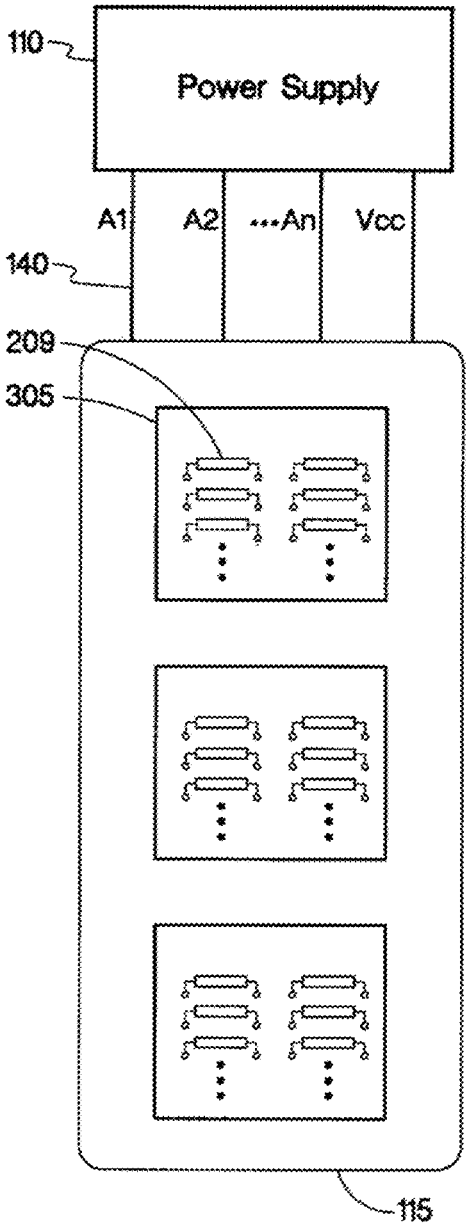
FIG. 3 is a block diagram of a conventional inkjet printhead.

FIG. 3 is a diagrammatic representation of a typical printhead including several primitives 305. Located inside of each primitive 305 are several heater resistors 209 that are coupled to their associated address lines numbered $A_1$ to $A_n$, where A represents the address and location of the heater resistor to be fired and n is an integer representing the number of addressable heater resistors within a primitive. The addressable heater resistors are fired with a series of electrical pulses that are generated by the power supply circuit 110 (commonly referred to as the drive circuit). In conventional designs when the printhead is required to print a solid color/black image (blackout mode) or vertical lines on the printing medium, a heater resistor in each primitive is simultaneously fired.

Primitives are individually supplied electrical current in sequence from the electrical power supply located in the printer. To complete the electrical circuit, a ground, or common, return conductor returns the electrical current to the power supply. Each heater resistor within a primitive has its own associated switch circuit such as a field effect transistor. Each switch circuit is connected to an address pad that receives signals from the printer for activating the switch circuit into a conductive state to allow the heater resistor associated with the switch circuit to be fired. When the printhead is operated, the printer cycles through the addresses such that only a single heater resistor is energized at a time for a particular primitive. However, multiple primitives can be fired simultaneously. For maximum print densities, all of the primitives may be fired simultaneously (but with a single heater resistor energized at a time for each primitive). In one such embodiment, each address line is connected to all of the primitives on the printhead. In another embodiment, each address line is only connected to some of the primitives. In a preferred embodiment, each primitive is connected to a separate primitive select line.

The number of primitive select lines correspond to the number of primitives. When a particular heater resistor is energized the address associated with that resistor is activated to put the switch circuit associated with that particular resistor into a conducting condition that provides a low resistance path to current that would flow through the switch circuit and through the heater resistor. Then, while the switch is conducting, a high current firing pulse is applied to the primitive select line to energize the particular heater resistor. After firing, the address line is deactivated to place the switch circuit into a non-conducting state.

For a particular heater chip design, each heater is individually addressable with a designated number of address cycles per address window with two fire signals in each address cycle. The total number of simultaneous firing heaters sets the number of heater primitive groupings which in turn sets the number of heaters per primitive. Each of the heaters is assigned a unique address which is usually transmitted as part of the address data stream or ADATA.

With each of the heaters in a primitive group receiving a unique address, a method to provide a unique address to each of the primitive groups must be defined. This is the primitive data stream or PDATA. For each address cycle, the PDATA stream must contain enough information to select any combination of the available heaters in the primitive for the fire 1 time slice as well as for the fire 2 time slice.

Figure 4:
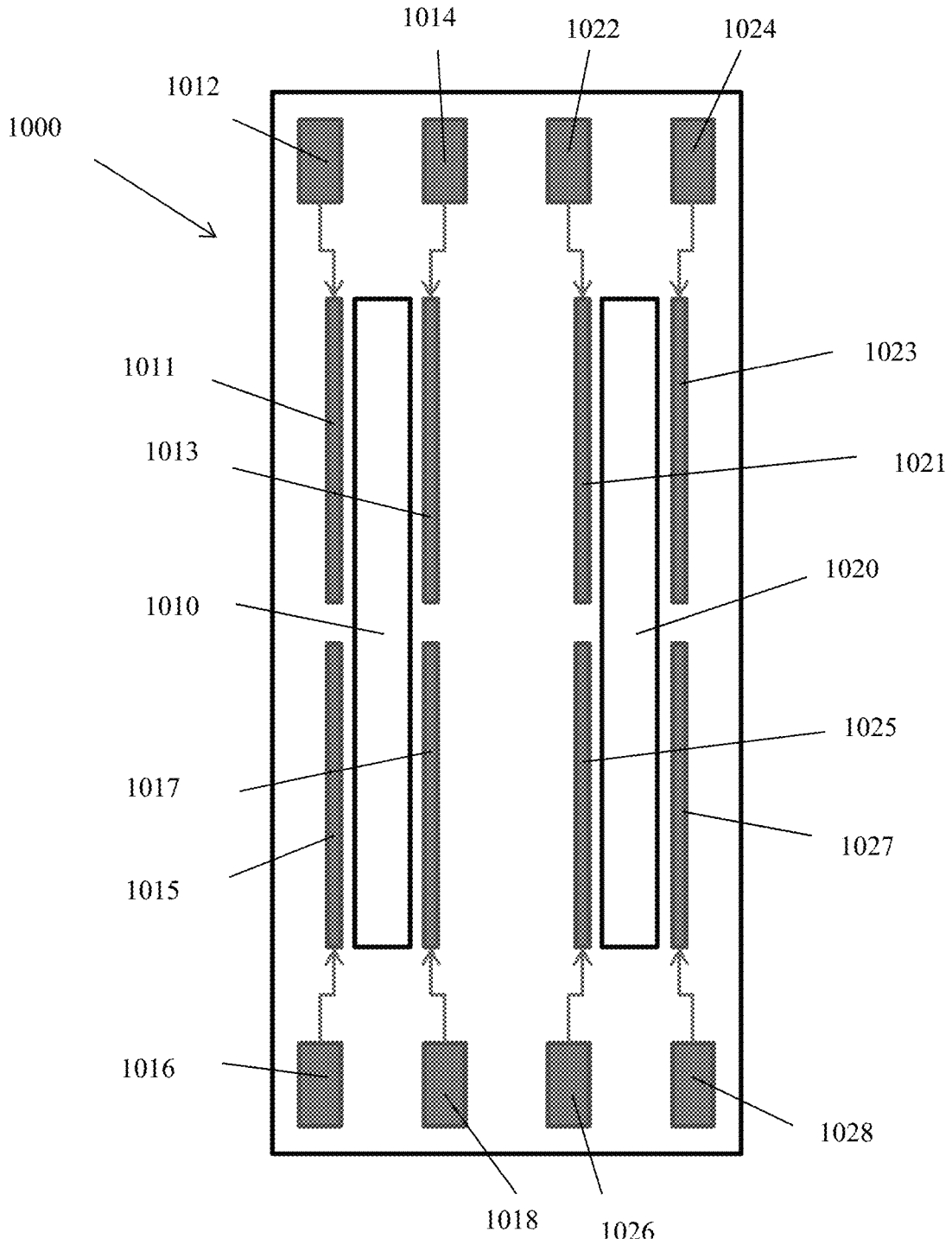
FIG. 4 is a block diagram of an inkjet printhead according to an exemplary embodiment of the present invention.

FIG. 4 is a block diagram of a printhead chip, generally designated by reference number 1000, according to an exemplary embodiment of the present invention. As an example, a printhead chip may have 1344 heaters per via with eight address cycles and 2 fire signals in each address cycle. This sets the maximum number of simultaneous fires at 1344/(8*2)=84. Since the number of simultaneous fires sets the number of heaters per primitive; there would be 1344/84=16 heaters per primitive for this example. To be able to select any of the 84 available heaters in either fire time slice, 84*2=168 bits would need to be transferred during the 3.086 us address cycle time. This equates to a transfer rate of about 56 MHz.

For previous inkjet printer designs, the data transfer clock frequency has been between 10 MHz and 18 MHz. Running at 56 MHz would be problematic from both an EMC and data integrity perspective. One option for reducing the required clock frequency is to increase the number of inputs for the PDATA stream.

For printhead chip 1000, the PDATA stream is divided into four inputs 1012, 1014, 1016, 1018 and 1022, 1024, 1026, 1028 for each via 1010, 1020 where each input is connected to a register 1011, 1013, 1015, 1017 and 1021, 1023, 1025, 1027 each made up of 42 bits (42*4=168 bits). This requires a total of eight PDATA inputs to the chip but reduces the transfer clock frequency to about 14 MHz. This configuration might be optimal for a less expensive desktop printer.

Figure 5:
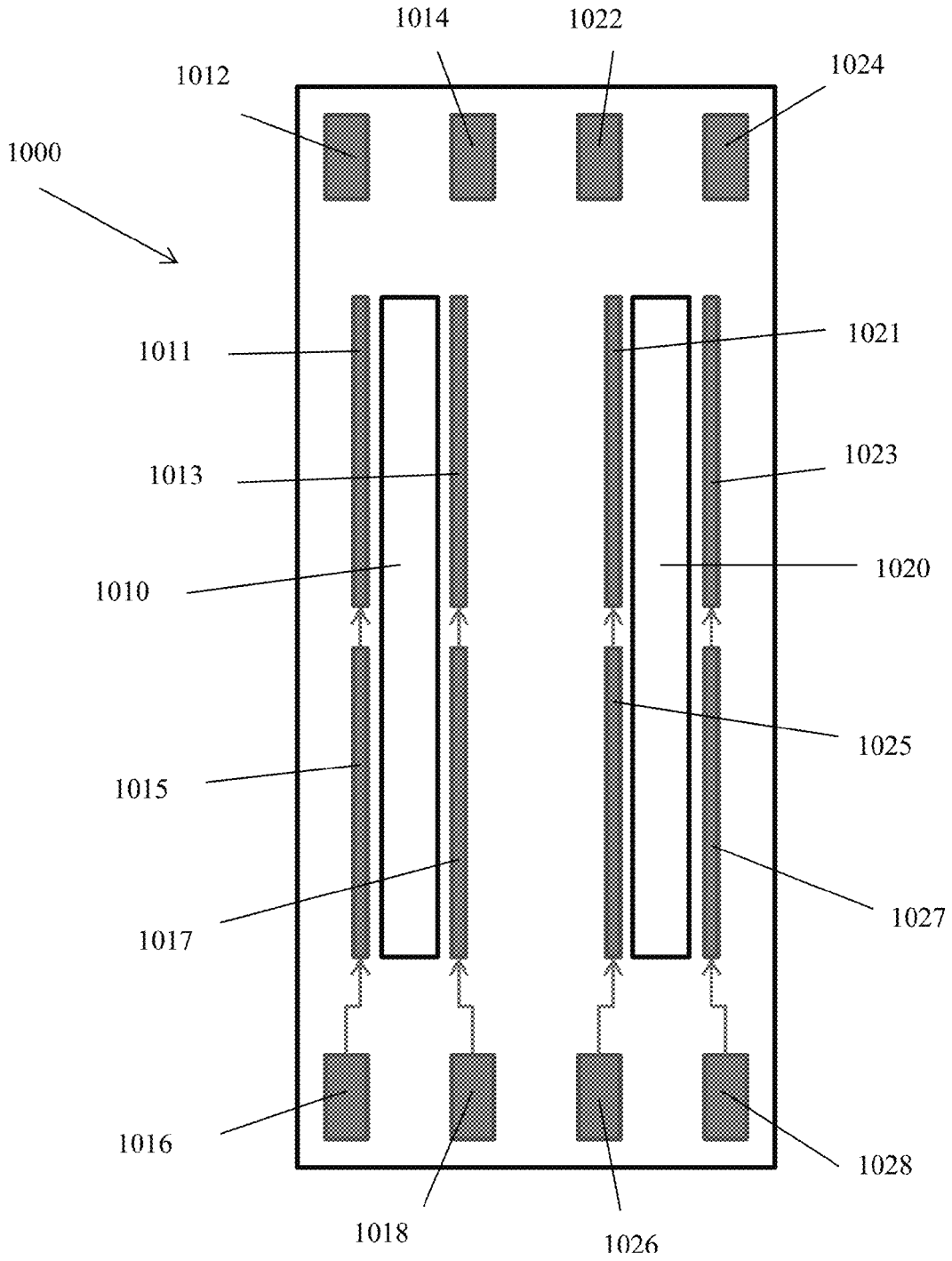
FIG. 5 is a block diagram of an inkjet printhead according to another exemplary embodiment of the present invention.

FIG. 5 shows the printhead chip 1000, but in this case, two PDATA registers 1011 and 1015; 1013 and 1017; 1021 and 1025; 1023 and 1027 along the same sides of vias 1010, 1020 are combined to form larger PDATA registers. When configured to be one register, the eight 42 bit PDATA registers are effectively turned into four 84 bit PDATA registers. This configuration would require only four PDATA inputs but increase the transfer clock frequency to about 28 MHz. This configuration might be better suited to a large format plotter application. In another exemplary embodiment, the chip could also be configured to have only two PDATA inputs each running at 56 MHz.

By default, the chip would use all four PDATA inputs per via. Two methods of reducing the number of inputs and increasing the bits per register could be used—one permanently, one temporarily. To permanently decrease the number of inputs in use, fuse circuitry can be used. Two fuse circuits that could be accessed via the input data stream could be used to configure the number of inputs—one to decrease from four inputs/shift registers per ink via to two and a second to decrease from two inputs/shift registers per ink via to one. Once the fuse is blown, combinational logic may continuously choose to use the output from the adjacent register as the input instead of the input data from the pad. Bits in the input data stream could also be used to temporarily change the number of inputs; however, the configuration designated by the fuse circuitry will always take precedence. For example, if the first fuse bit has already been blown, the chip would permanently use only two inputs no matter what was sent in the input data stream but could still be set to one input temporarily by setting the appropriate bits in the input data stream. Using the input data stream may require sending the correct bits with each address cycle to configure the inputs.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A printhead comprising:

a single fluid ejector chip comprising a first number of heating elements, the heating elements being divided into groups of a second number of heating elements so as to form a number of primitive groups, one or more of the first number of heating elements being fired simultaneously during each of one or more address cycles of a printing operation; and an electrical interface comprising:

one or more inputs for receiving respective primitive address data and heater address data corresponding to each of the one or more address cycles, at least one of the one or more inputs being switchable to a deactivated state to change a total number of the one or more inputs; and one or more shift registers, a total number of shift registers being reconfigurable so that each of the one or more shift registers corresponds to a respective one of the changed total number of the one or more inputs that is not in a deactivated state, the one or more shift registers receiving the respective primitive address data and heater address data from the one or more inputs that are not in a deactivated state to allow for selective application of electrical signals to the heating elements so that fluid is ejected from the single fluid ejector chip in accordance with image data, wherein the one or more shift registers are formed in the single fluid ejector chip.

2. The printhead of claim 1, further comprising one or more fuse circuits for switching the at least one of the one or more inputs to the deactivated state.

3. The printhead of claim 1, wherein the at least one of the one or more inputs is switched to a deactivated state in accordance with an input data stream.

4. The printhead of claim 1, wherein the total number of bits in each shift register is determined as follows: (total number of bits required to address a maximum number of the one or more heating elements simultaneously per address cycle)/(total number of inputs).

5. An inkjet printer comprising:

a housing;

a carriage adapted to reciprocate along a shaft disposed within the housing;

one or more printhead assemblies arranged on the carriage so that the one or more printhead assemblies eject ink onto a print medium as the carriage reciprocates along the shaft in accordance with a control mechanism, wherein at least one of the one or more printhead assemblies comprises:

a printhead comprising:

a single fluid ejector chip comprising a first number of heating elements, the heating elements being divided into groups of a second number of heating elements so as to form a number of primitive groups, one or more of the first number of heating elements being fired simultaneously during each of one or more address cycles of a printing operation; and an electrical interface comprising:

one or more inputs for receiving respective primitive address data and heater address data corresponding to each of the one or more address cycles, at least one of the one or more inputs being switchable to a deactivated state to change a total number of the one or more inputs; and one or more shift registers, a total number of shift registers being reconfigurable so that each of the one or more shift registers corresponds to a respective one of the changed total number of the one or more inputs that is not in a deactivated state, the one or more shift registers receiving the respective primitive address data and heater address data from the one or more inputs that are not in a deactivated state to allow for selective application of electrical signals to the heating elements so that fluid is ejected from the single fluid ejector chip in accordance with image data, wherein the one or more shift registers are formed in the single fluid ejector chip.

6. The inkjet printer of claim 5, further comprising one or more fuse circuits for switching the at least one of the one or more inputs to the deactivated state.

7. The inkjet printer of claim 5, wherein the at least one of the one or more inputs is switched to a deactivated state in accordance with an input data stream.

8. The inkjet printer of claim 5, wherein the total number of bits in each shift register is determined as follows: (total number of bits required to address a maximum number of the one or more heating elements simultaneously per address cycle)/(total number of inputs).

* * * * *